US006267153B1

(12) United States Patent
Stocchi

(10) Patent No.: US 6,267,153 B1
(45) Date of Patent: Jul. 31, 2001

(54) PROCESS FOR FILLING CONTAINERS SIMULTANEOUSLY WITH THEIR STERILIZATION

(76) Inventor: Gabriele Stocchi, Via Carducci, 2, Montechiarugolo (IT), 1-43030

( * ) Notice: Subject to any disclaimer, the term of this patent is extended or adjusted under 35 U.S.C. 154(b) by 0 days.

(21) Appl. No.: 09/424,040

(22) PCT Filed: May 26, 1998

(86) PCT No.: PCT/IB98/00816

§ 371 Date: Nov. 17, 1999

§ 102(e) Date: Nov. 17, 1999

(87) PCT Pub. No.: WO98/55364

PCT Pub. Date: Dec. 10, 1998

(30) Foreign Application Priority Data

Jun. 6, 1997 (IT) ..... BO97A0339

(51) Int. Cl.[7] ..... B67C 3/00

(52) U.S. Cl. ..... 141/7; 141/48; 141/92

(58) Field of Search ..... 141/1, 4, 5, 6, 141/7, 11, 39, 46, 48, 50, 85, 89, 91, 92, 93

(56) References Cited

U.S. PATENT DOCUMENTS

| | | | | |
|---|---|---|---|---|
| 2,695,743 | * | 11/1954 | Wetherby-Williams | 53/650 |
| 3,209,794 | * | 10/1965 | Granier | 141/46 |
| 5,445,194 | * | 8/1995 | Clusserath | 141/39 |
| 5,501,253 | * | 3/1996 | Weiss | 141/40 |
| 5,558,135 | * | 9/1996 | Kronseder et al. | 141/6 |

FOREIGN PATENT DOCUMENTS 43 26 346 2/1995 (DE) .

* cited by examiner

*Primary Examiner*—Gregory L. Huson
*Assistant Examiner*—Peter deVore
(74) *Attorney, Agent, or Firm*—Brown, Martin, Haller & McClain LLP

(57) ABSTRACT

A process for filling containers simultaneously with their sterilization, including also the evacuation of the aeriform content of the containers that is exhausted directly to the outside without flowing back in the general tank containing the filling process fluids.

2 Claims, 6 Drawing Sheets

PROCESS FOR FILLING CONTAINERS SIMULTANEOUSLY WITH THEIR STERILIZATION

FIELD OF THE ART

The present invention refers to plants for bottling liquids, particularly to the aseptic filling of sterilised liquids.

STATE OF THE ART

The bottling processes currently known entail the employment of sterilised and completely insulated environments, inside which every machinery that perform the filling process is installed.

To manage these plants is though necessary that the control and supervision technicians are able to enter these sterilised environments, and this entails the risk of contamination.

The problem to be solved is to sterilise the containers and the keep them sterilised, especially during the filling phase.

The solution presented in this invention allows to obtain an inexpensive and safe sterilisation of the containers, simultaneously with their filling process.

DESCRIPTION

The invention is now disclosed in the following detailed description, with reference to the figures of the attached drawings, as not limiting example.

Figure 1:
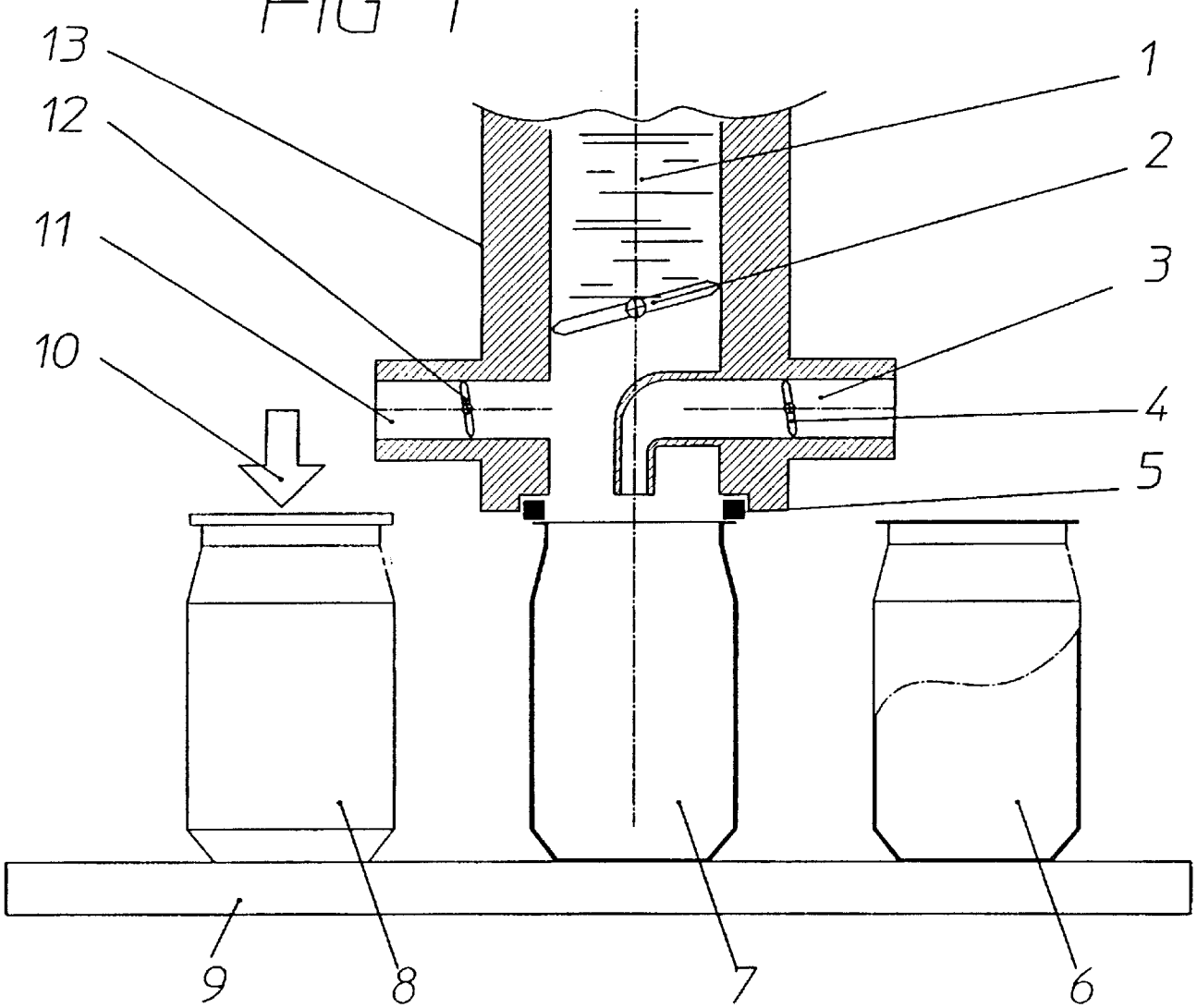
FIG. 1 is a scheme of the starting phase of the filling process during which the container is placed under the filling faucet.
Figure 2:
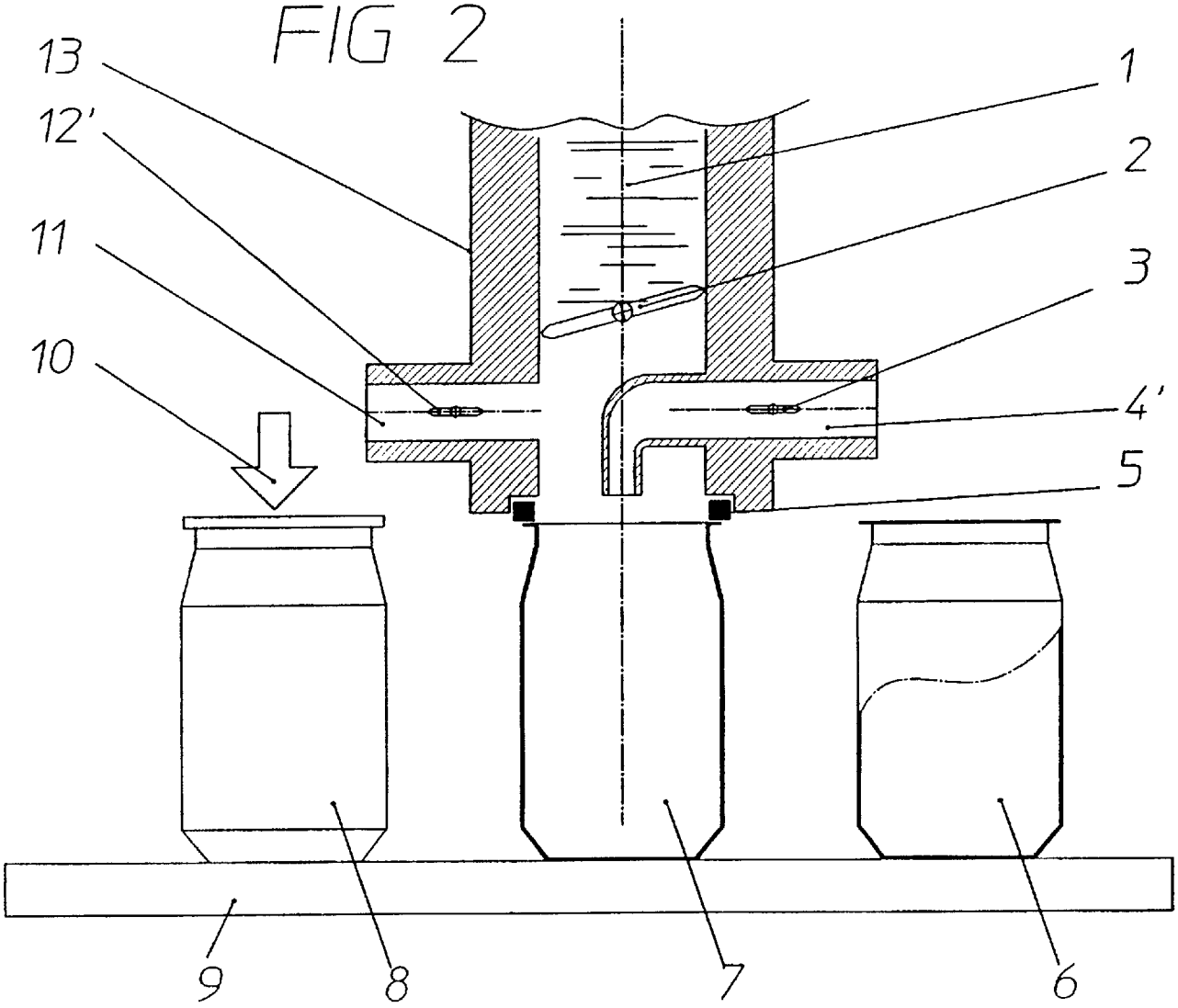
FIG. 2 is a scheme of the sterilisation phase that occurs before the beginning of the filling. During this phase the water steam spray that is injected in the container produces the evacuation of the aeriform content inside the container.
Figure 3:
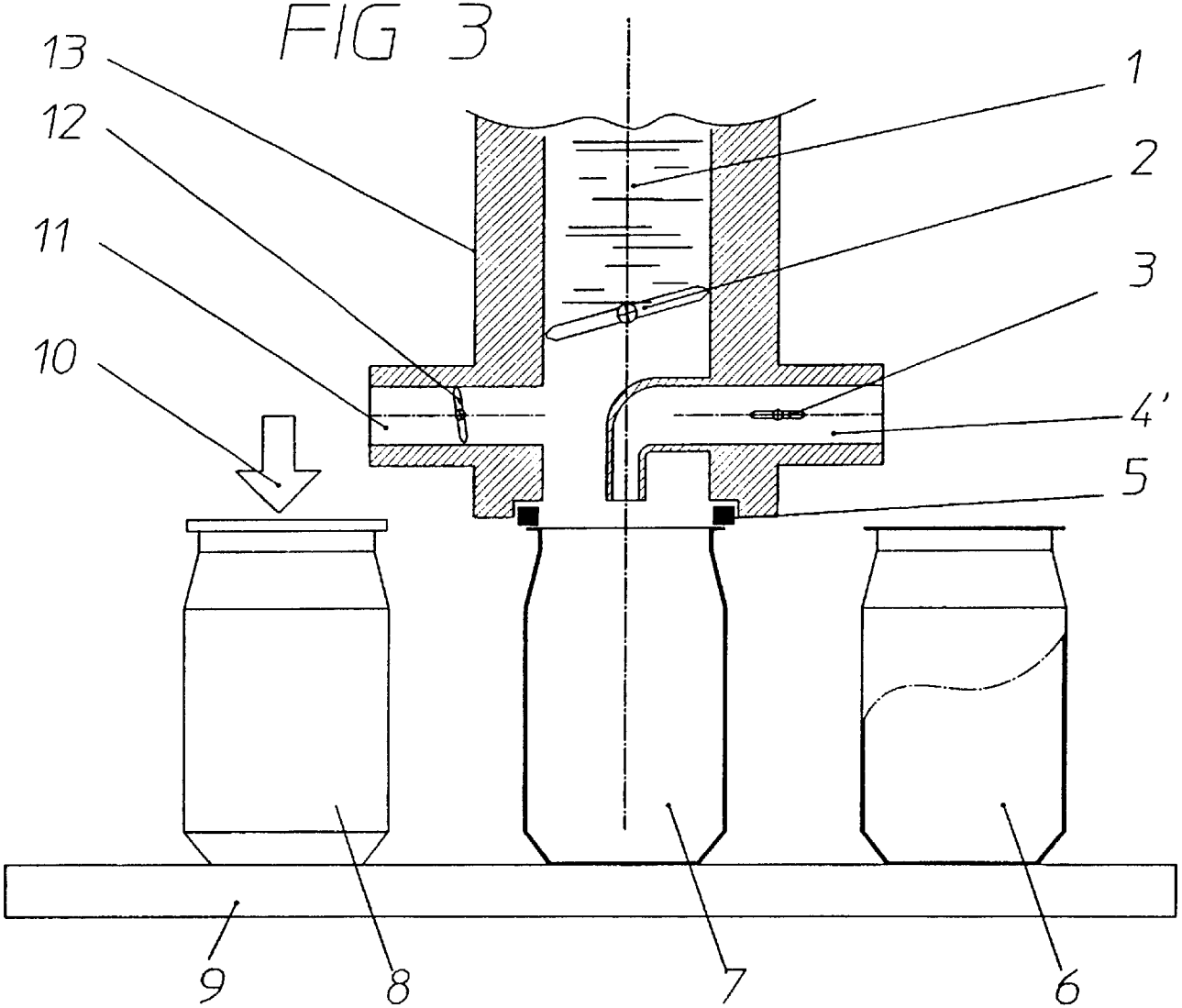
FIG. 3 shows the phase during which the steam pressure inside the container is reaching the pressure of the filling liquid; once said pressure is reached, the faucet will open automatically.
Figure 4:
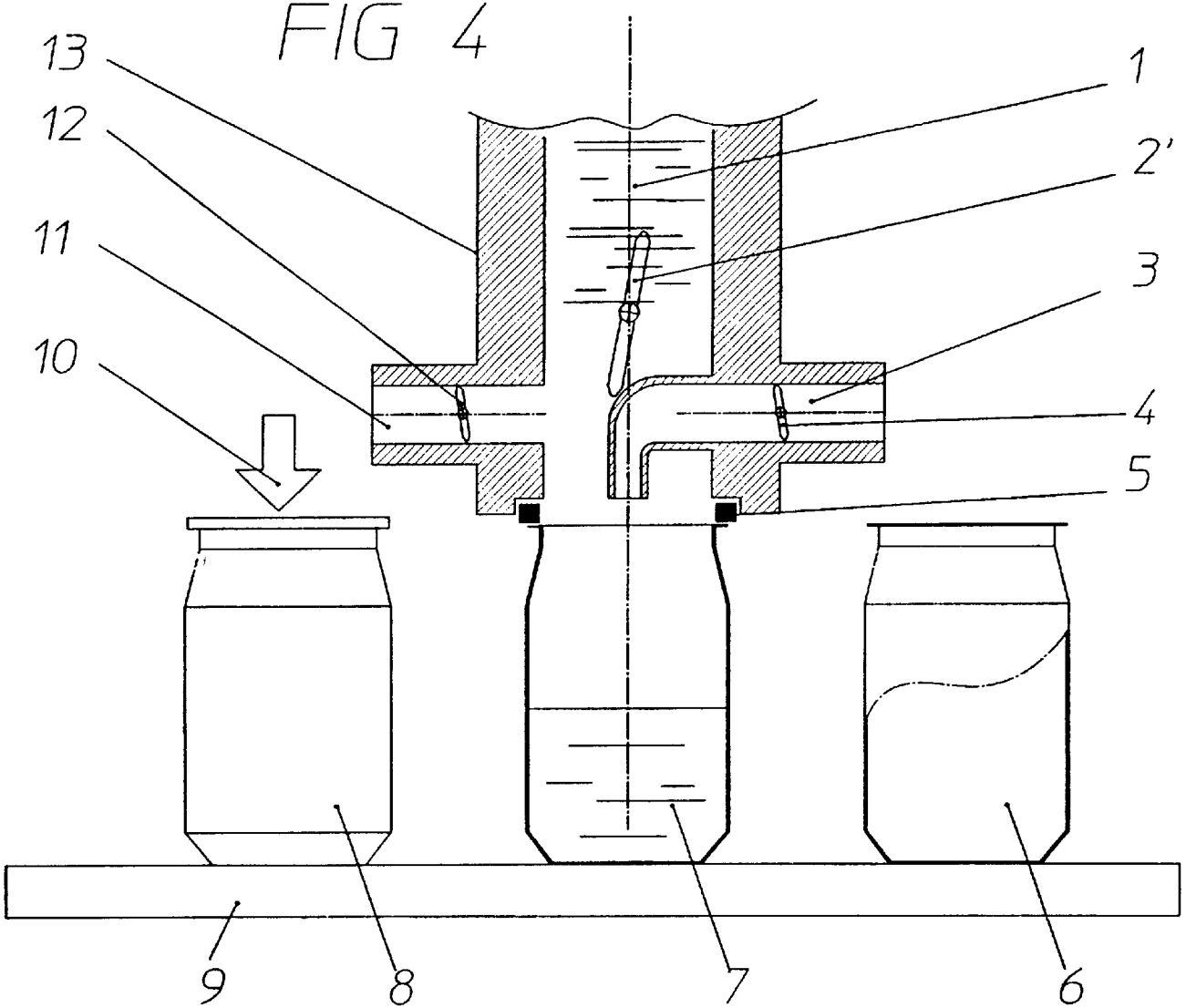
FIG. 4 shows the filling phase. It can be observed the absence of the traditional venting tube, that is indeed not necessary because the steam, on contact with the liquid, condenses and frees the volume of the containers that will then be filled.
Figure 5:
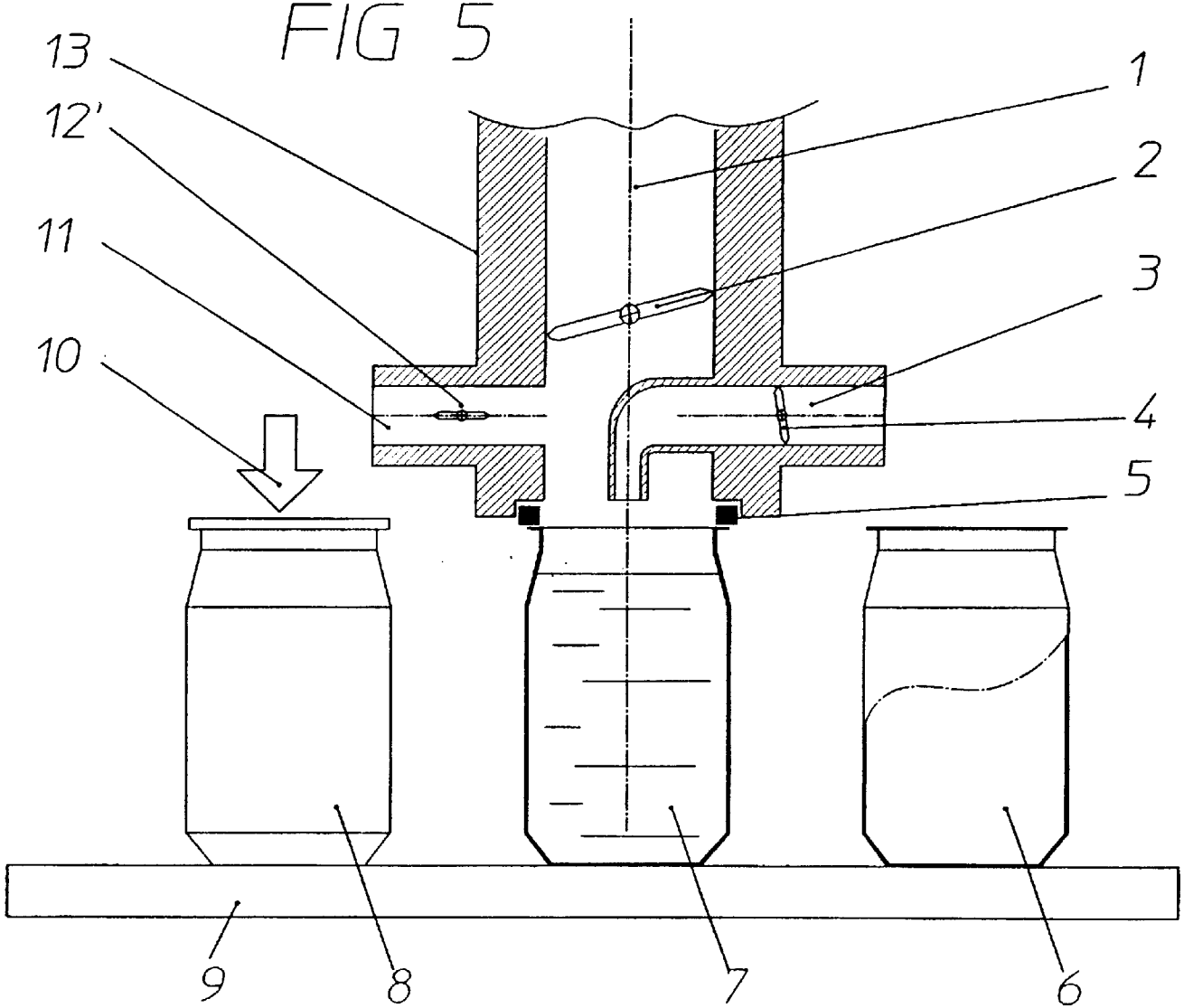
FIG. 5 shows the final phase of the process during which the already opened container is brought back to the atmospheric pressure level.
Figure 6:
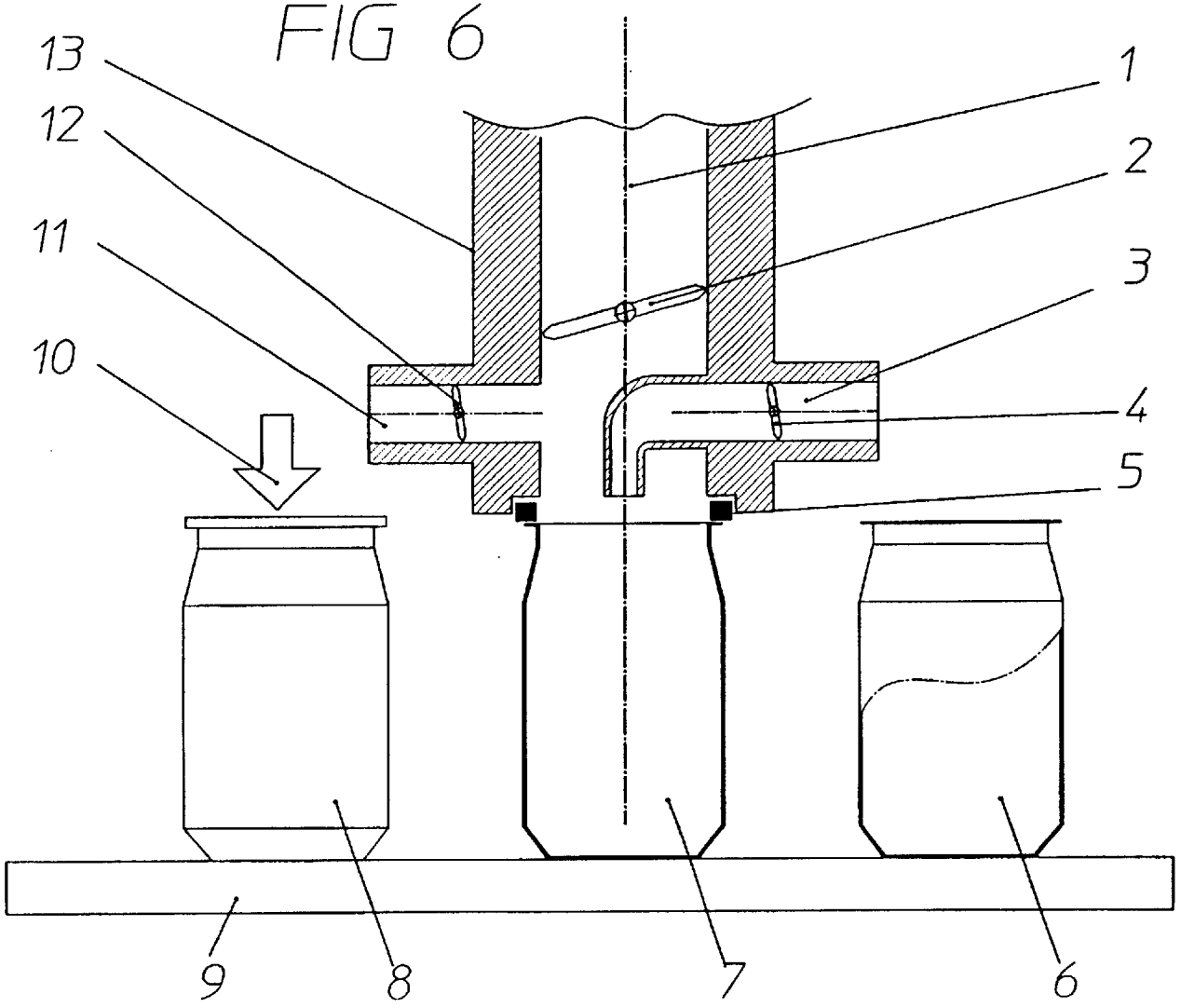
FIG. 6 shows the beginning of a new process.

In the figures of the schematic drawings every single detail is marked as follows:

1 is the entry conduit of the filling liquid.
2 is the closed faucet.
2' is the open faucet.
3 is the entry conduit of the sterilised steam.
4 is the steam valve open.
4' is the steam valve closed.
5 is the sealing gasket on the container's mouth.
6 is a coming empty container.
7 is a container during the process of sterilisation and filling.
8 is a container sterilised, filled and sealed.
9 is the support for the running containers.
10 is the operation of tapping the containers.
11 is the exhaust conduit of the atmospheric content of the container.

12 is the exhaust valve closed.
12' is the exhaust valve open.
13 is the body of the filling faucet.

The clearness of the figures points out the performance of the process during the different operational phases. The invention could obviously be changed in several manners as far as the structural proportions of the devices and the technological choices of the construction materials are concerned.

It is clear that the process can be realised on every kind of filling machine, for any fluid, also carbonated. The filling grade of the containers can be controlled using volumetric or electronic filling valves.

The technical realisations of the process could be different, holding the basic principle to sterilise the containers, with a overheated sterilising steam flow, simultaneously with the filling operations, as schematically shown as a not limiting example.

The manipulation of the containers and their position under the filling faucet can obviously be performed by different actuation devices.

It is thus evident that all those bottling processes that perform the preliminary sterilisation of the container and its pre-evacuation simultaneously with the filling operations, according to the schemes described, shown and hereinafter claimed, will be included in the protection field of the present invention.

What is claimed is:

1. An apparatus for sterilizing and filling containers, comprising:

a sterilizing and filling station having a first conduit for supplying filling liquid to a container, a second conduit for supplying steam to the container, and an exhaust conduit for exhausting the container to the surrounding atmosphere;

a conveyor for moving a series of containers into position beneath the sterilizing and filling station;

a first valve in the first conduit for controlling supply of filling liquid to a container;

a second valve in the second conduit for controlling supply of steam to the container;

an exhaust valve in the exhaust conduit for controlling exhaust of the container; and the first conduit is substantially vertical and has a downwardly directed outlet with a central vertical axis, and the second conduit downstream of said first valve projects transversely into said first conduit and has a downwardly directed outlet coaxial with said central axis, the second conduit outlet being of smaller diameter than said first conduit;

whereby the second valve and exhaust valve are opened to supply steam to the empty container and exhaust aeriform content from the container, and the second valve is subsequently closed and the first valve is opened to supply filling liquid to the container, whereby sterilization and filling is carried out at a single station.

2. An apparatus for sterilizing and filling containers, comprising:

a sterilizing and filling station having a first conduit for supplying filling liquid to a container, a second conduit for supplying steam to the container, and an exhaust conduit for exhausting the container to the surrounding atmosphere;

a conveyor for moving a series of containers into position beneath the sterilizing and filling station;

a first valve in the first conduit for controlling supply of filling liquid to a container;

a second valve in the second conduit for controlling supply of steam to the container;

an exhaust valve in the exhaust conduit for controlling exhaust of the container; and the exhaust conduit projecting transversely out of said first conduit;

whereby the second valve and exhaust valve are opened to supply steam to the empty container and exhaust aeriform content from the container, and the second valve is subsequently closed and the first valve is opened to supply filling liquid to the container, whereby sterilization and filling is carried out at a single station.

* * * * *